US007451680B1

(12) United States Patent
Pelto

(10) Patent No.: US 7,451,680 B1
(45) Date of Patent: Nov. 18, 2008

(54) SUBMARINE STEAM GENERATOR MISSILE EJECTION SYSTEM

(75) Inventor: John H. Pelto, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 192 days.

(21) Appl. No.: 11/584,116

(22) Filed: Oct. 20, 2006

(51) Int. Cl.
*F41F 3/00* (2006.01)
*F41B 11/00* (2006.01)

(52) U.S. Cl. ..... 89/1.81; 89/1.8; 89/1.82; 124/56; 124/71

(58) Field of Classification Search ..... 89/1.8, 89/1.81, 1.82; 124/56, 71
See application file for complete search history.

(56) References Cited

U.S. PATENT DOCUMENTS 3,003,572 A * 10/1961 Sanger ..... 180/7.3
3,029,704 A * 4/1962 Truax ..... 89/1.806
3,087,451 A * 4/1963 Chandler ..... 60/227
3,131,597 A * 5/1964 Smith et al. ..... 89/8
3,182,554 A 5/1965 Barakauskas
3,373,657 A * 3/1968 Guin ..... 89/1.81
3,379,163 A * 4/1968 Wiethoff ..... 114/238
3,425,316 A * 2/1969 Nixon et al. ..... 89/1.818
3,430,619 A * 3/1969 Bolta et al. ..... 124/71
3,807,274 A * 4/1974 Cohen ..... 89/1.81
3,944,019 A 3/1976 Pauletich
4,014,246 A 3/1977 Nissley, Jr.
4,430,942 A * 2/1984 Heyman ..... 102/520
4,436,016 A * 3/1984 Olmsted et al. ..... 89/1.809
4,470,562 A * 9/1984 Hall et al. ..... 244/3.2
4,485,719 A * 12/1984 Mendelsohn et al. ..... 89/1.816
4,643,072 A * 2/1987 Hillebrecht ..... 89/1.81
4,724,738 A 2/1988 Johnson
4,767,364 A 8/1988 Lenz
5,217,188 A * 6/1993 Thole et al. ..... 244/159.4
5,737,962 A 4/1998 Turner et al.
5,785,038 A * 7/1998 Mattern ..... 124/56
5,929,369 A * 7/1999 Bissig et al. ..... 102/334
6,290,184 B1 9/2001 Paterro
6,318,229 B1 * 11/2001 Nevels et al. ..... 89/1.816
7,104,507 B1 * 9/2006 Knight ..... 244/171.1
2006/0059764 A1 * 3/2006 Triano et al. ..... 43/19

FOREIGN PATENT DOCUMENTS

WO WO 2006056742 A1 * 6/2006

* cited by examiner

*Primary Examiner*—Bret Hayes
(74) *Attorney, Agent, or Firm*—James M. Kasischke; Michael P. Stanley; Jean-Paul A. Nasser

(57) ABSTRACT

A steam generator missile ejection system has a vessel that contains water that becomes the pressurized steam source for missile ejection. A heating system within the vessel heats the water to steam and to the desired launch pressure. The heater is controlled to sequence operation and heat generation with a command from a controller shortly before initiation of a firing valve. A valve controls piping from the vessel to direct steam to a piping header and onto the ejection chamber of a launch tube. This event provides the launch pulse required to eject the payload from the missile tube. The launch energy requirements can be modulated by varying the pre-launch temperature of the water in the pressure vessel and can be controlled by an opening rate and length of open duration of the valve.

12 Claims, 1 Drawing Sheet

SUBMARINE STEAM GENERATOR MISSILE EJECTION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a missile ejection system and more particularly to an ejection system using steam as a prime mover or dynamic force to eject a missile.

(2) Description of the Prior Art

Current naval missile ejection systems are totally reliant on ordnance gas generators. Ordnance gas generators produce a hot exhaust gas via a controlled propellant burn that provides the dynamic force used to eject the missile from a missile launch tube or capsule.

The ordnance gas generator was preceded in early launching systems by a high pressure air systems. The high pressure air systems were large and complex due to requirements for air flasks, piping and associated isolation valves. The move to gas generators was necessitated by a need to reduce system complexity, reduce maintenance and increased launching system operational confidence.

However, ordnance gas generators have brought the added burden of explosive ordnance safety concerns. These safety concerns include significant costs for safe transport; bunkering and test firings to ensure explosive grain stability and safe ejection performance. Additional costs for aging/performance of the grain using analysis and live fire tests are expensive.

Also, when gas generators reach the expected acceptable performance end of life, the generators must be disposed at a typically high cost due to explosive and hazardous material. Overall, the cost in labor, analysis, documentation and logistical storage and transport needed to support current gas generator technology is significant.

As such, a need exists to remove hazardous material disposal costs for post missile launches and costs associated with outdated or exceeding operational service life disposal of gas generators.

A further need exists to eliminate explosive ordnance bunker maintenance and personnel monitoring costs.

As discussed below, alternative methods for submerged missile ejection are the current use of gas generators or a return to the use of high pressure air for an ejection pulse.

Paterro (U.S. Pat. No. 6,290,184) describes two steam generators combined with air compressors that supposedly produce a constant flow of steam and air for propulsion. However, the cited reference does not describe a static pressure vessel that contains water at high temperature and pressure until a firing valve allows an explosive release of pressure, thus flashing the water to steam and providing thrust for missile ejection.

Barakauskas (U.S. Pat. No. 3,182,554) discloses a solid fuel gas generator for the missile ejection system. The cited reference discloses that the water contained in a cooling chamber has a primary use of cooling a high temperature ejection gas from a gas generator. The high temperature ejection gas needs to be cooled to prevent damage to the missile structure and rocket motor. Therefore, the water in this case is primarily used for hot ejection gas cooling with some residual thrust provided when the cooling water flashes to steam. The cited reference does not use water heated to steam and pressurized in a pressure vessel to provide the sole means of eject thrust for a missile or other payload from a launch tube.

Pauletich (U.S. Pat. No. 3,944,019) is designed as a constant source of steam suspended from a cable at sea. The steam would be pulsed into a bell chamber to produce a sound pulse supposedly useful for geological study of the ocean floor. The cited reference does not have a static pressure vessel filled with water that would be maintained when armed to eject a missile at high temperature and pressure until a firing valve allows an explosive release of pressure.

Nissley, Jr. (U.S. Pat. No. 4,014,246) uses a boiler to provide a steam source to a pressurized volume referred to as a "rocket" for launching a flying vehicle from a ground rail launch system. In the cited reference, the steam producing boiler is separate from the pressurized volume (rocket) and is connected via a piping header from the boiler to the pressurized volume. The cited reference is not structurally designed as a single unit that incorporates a pressure vessel, water supply system, electrical energy resistance heater to heat the water and firing valve in a common unit.

Johnson (U.S. Pat. No. 4,724,738) describes a design that does not utilize a pressure vessel to contain a heated pressurized water source. The water used in the cited reference is contained in the "Rocket" launch cylinder and functions primarily as a cooling source to lower the temperature of the rocket booster motor when initiated. The cited reference does not utilize a pressure vessel to contain a heated pressurized water volume until the firing valve releases the pressurized water that flashes to steam and ejections the missile or payload from the launch tube.

Lenz (U.S. Pat. No. 4,767,364) describes a ship propulsion source using a steam boiler and piped steam sourcing two propulsion jets fixed to the aft end of a ship. This cited reference does not utilize a static pressure vessel to contain a heated and pressurized water source designed for explosive release of steam to launch a missile or payload for a missile launch tube.

Turner et al. (U.S. Pat. No. 5,737,962) utilizes a steam source from a boiler that is piped to a torpedo test stand. The piped steam source is connected to a torpedo propulsion afterbody and thus provides the energy required to operate the propulsion motor at rated speed and power, without using toxic fuel that is typically used for torpedo propulsion. However, the cited reference is not designed as a unitary pressure vessel missile steam ejection launching source.

SUMMARY OF THE INVENTION

Accordingly, it is a general purpose and primary object of the present invention to provide a variable ejection energy pulse system suitable to launch diverse payloads.

A further object of the present invention is to provide a system using currently available shipboard sources of electrical power and de-mineralized water.

Other objects and advantages are attained with the submarine steam generator missile ejection system (SSGMES) of the present invention which generally include a pressure vessel that contains heated and pressurized water that becomes the steam source for missile ejection. An electrical resistance heating system heats the water to the desired temperature for steam and launch pressure.

An ejection system firing valve and an associated ejection header manifold isolates and directs a steam ejection pulse from the pressure vessel to an ejection discharge header and onto an ejection chamber of a launch tube.

The pressure vessel is sized for the swept volume needed to provide a saturated steam ejection pulse for the heaviest payload and/or multiple ejection pulses supporting a missile salvo launch. The pressure vessel is encapsulated in an insulating jacket to reduce energy consumption and to ensure personnel safety.

A first stage heater and a second stage heater of the electrical heating system provides the energy to raise the pressure of the water contained inside the pressure vessel. The second stage heater ensures a thoroughly vaporized high temperature steam flow from the pressure vessel for missile ejection. The second stage heater is controlled in a manner that sequences operation and heat generation with a "Prepare" command from a controller shortly before initiation of the firing valve. The second stage heater is switched off with the initiation command of the firing valve. The launch energy requirements of the SSGMES can be modulated by varying the pre-launch temperature of the water in the pressure vessel.

The firing valve functions as the pressure isolator of the system. When the pressure vessel is heated and pressurized to the launch ejection energy needs; the opening of the firing valve initiates steam release from the pressure vessel and subsequent flow via the ejection header manifold to the missile launch tube ejection chamber. This event provides the ejection steam launch pulse required to eject the payload from the missile tube. The launch energy requirements can be controlled by the opening rate and length of open duration of the ejection firing valve.

BRIEF DESCRIPTION OF THE DRAWINGS

Further objects and advantages of the present invention will become readily apparent from the following detailed description and claims in conjunction with the accompanying drawing wherein:

DESCRIPTION OF THE PREFERRED EMBODIMENT(S)

Figure 1:
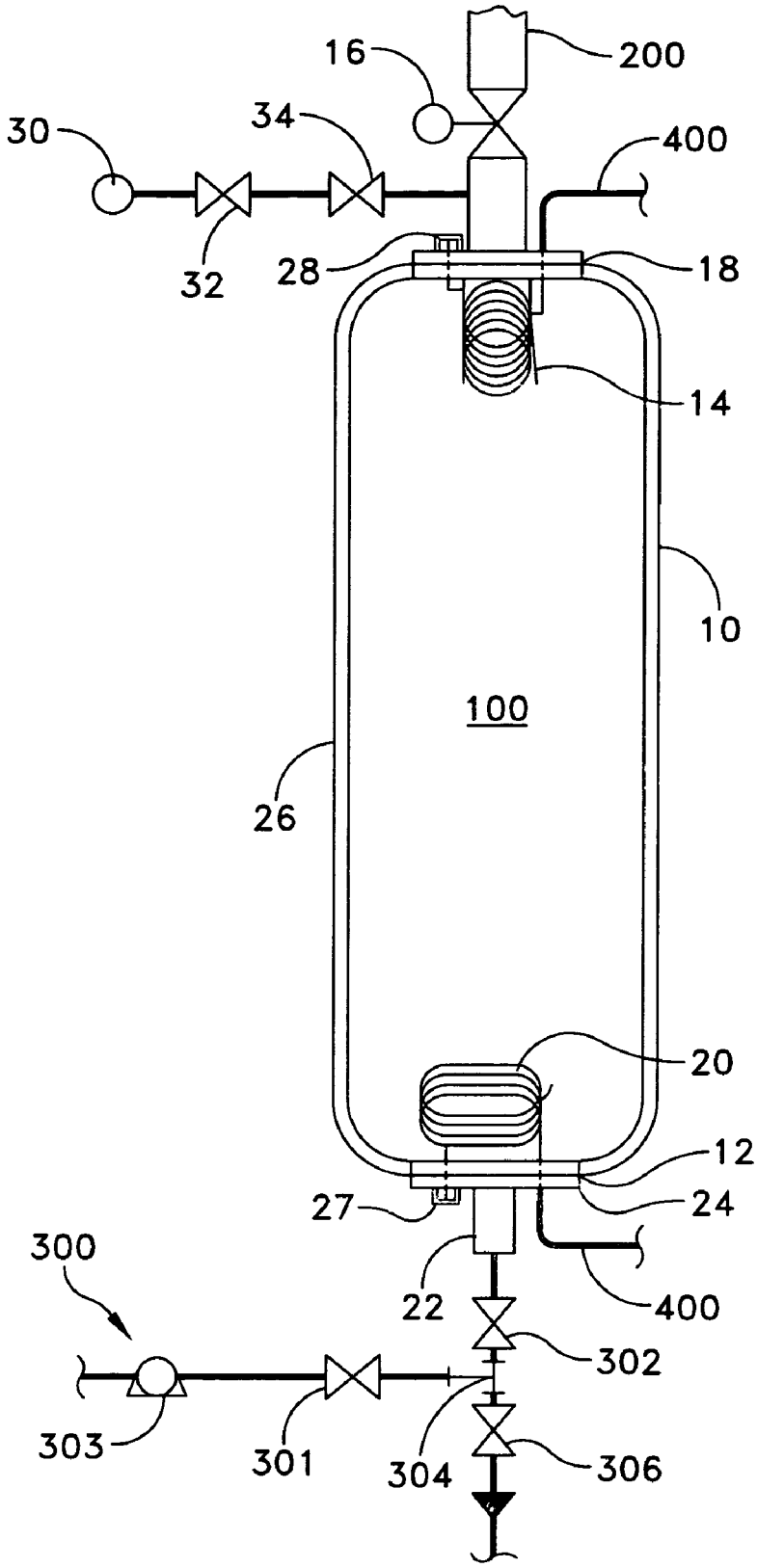
FIG. 1 is a schematic of the submarine steam generator missile ejection system of the present invention.

Referring now to FIG. 1, the submarine steam generator missile ejection system (SSGMES) of the present invention primarily comprises a pressure vessel 10 that contains heated and pressurized water 100 that becomes the steam source for missile ejection. An electrical resistance heating system having a first stage heater 20 and a second stage heater 14 contained inside the pressure vessel 10 heats the water 100 to the desired temperature and launch pressure.

The SSGMES also includes an ejection system firing valve 16 that isolates the pressure vessel 10 to direct the steam ejection pulse to an ejection discharge header 200 and onto the bottom/ejection chamber of a launch tube (not shown). A de-mineralized water filling and drain system 300 is used to fill or drain the pressure vessel 10.

The pressure vessel 10 is preferably weldment constructed of stainless steel (certified for high temperature/pressures); however, other suitable materials known to those ordinarily skilled in the art may be used. Also, the pressure vessel 10 is sized for the sweeping volume needed to provide a saturated steam ejection pulse for the heaviest payload and/or multiple ejection pulses supporting missile salvo launch requirements. The pressure vessel 10 includes a mechanically bolted discharge and upper access flange 18 fluidly connected to the firing valve 16 and associated ejection piping header 200. The upper access flange 18 allows inspection and repairs access to the upper heating element 14.

The pressure vessel 10 has an additional mechanical flange 12 for inspection and repair of the lower heating element 20 of the two stage resistance heating system. The lower mechanical flange 12 incorporates a pipe stud 22 welded to a flange plate 24. The pipe stud 22 is approximately 6" long and functions as a well for solid particles to accumulate in and as an entry point for the de-mineralized water fill and drain system 300. The pressure vessel 10 is encapsulated in an insulating jacket 26 to reduce energy consumption and to ensure personnel safety.

A first stage heater 20 and second stage heater 14 of the two-stage electrical heating system provide the energy to raise the temperature and pressure of the water contained inside the pressure vessel 10. The first stage heater 20 is a large surface area resistance heating element located in the lower section of the pressure vessel 10. The first stage heater 20 transforms the water in the pressure vessel 10 to the desired saturated steam temperature and launch pressure. The heating element of the first stage heater 20 operates from a "four-forty (440)" VAC electricity source 400 typically in a submarine (not shown).

The heating element of the second stage heater 14 is located adjacent to the upper access flange 18. The function of the second stage heater 14 is to ensure a thoroughly vaporized high temperature steam flow from the pressure vessel 10 for missile ejection. The second stage heater 14 allows the steam to freely pass to the ejection piping, while adding heat to the ejection pulse. The coil design of the second stage heater 14, which accommodates high flow rates, has a large surface area for sufficient heat transfer to the steam flow to ensure that the flashed steam is finely atomized. The second stage heater 14 is provided by the "four-forty (440)" VAC electricity source 400 for power and is controlled in a manner that would sequence operation and heat generation with a "Prepare" command from a controller (not shown) shortly before initiation of the firing valve 16. The second stage heater 14 is switched off with the initiation command of the firing valve 16. The launch energy requirements of the SSGMES can be modulated by varying the desired pre-launch temperature of the water 100 in the pressure vessel 10.

The firing valve 16 is located adjacent or near the upper access flange 18 and functions as the pressure isolator of the SSGMES. When the water in the pressure vessel 10 is heated and pressurized to the launch ejection energy needs; the opening of the firing valve 16 initiates steam flow to the missile launch tube ejection chamber. This event provides the ejection steam launch pulse required to eject the payload from the missile tube. The launch energy requirements of the SSGMES can be controlled by opening rate and length of open duration of the ejection firing valve 16.

As stated above, the de-mineralized water fill and drain system 300 provides a means to fill or drain the pressure vessel 10. The point of attachment is preferably at the pipe stud 22. Filling is accomplished by opening isolation valves 301, 302 and operating a positive displacement pump 303 that supplies de-mineralized water to the pressure vessel 10. A pipe tee 304 and drain isolation valve 306 on the fill line serve to drain the system water to a bilge or alternate drain collection system.

The pressure vessel 10 includes various monitoring systems that can be used for control of the SSGMES or to support other indicating systems. These include a lower temperature sensor 26 for the first stage heater 12 and an upper temperature sensor 28 for the second stage heater 14. Also, a pressure sensing system including a gauge 30, gauge valve 32 and root valve 34 are provided to indicate whether adequate steam pressure exists for a missile launch.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for missile ejection, said system comprising:

a piping header;

a pressure vessel fluidly connected to said piping header, said pressure vessel capable of containing pressurized water and steam;

a first stage heater positioned within and at a first end of said pressure vessel, said first stage heater capable of heating the pressurized water;

a second stage heater positioned within and at a second end of said pressure vessel, said second stage heater capable of heating the pressurized water to steam; and a firing valve fluidly connected to said pressure vessel and said piping header;

wherein steam generated within said pressure vessel is controllable by said firing valve to transmit by said piping header to provide launching power for the missile ejection.

2. The system in accordance with claim 1, wherein the heating operation of said second stage heater is controlled by the operation of said firing valve.

3. The system in accordance with claim 2, wherein the heating operation of said second stage heater is controlled by a controller prior to the operation of said firing valve.

4. The system in accordance with claim 3, wherein said system further comprises a de-mineralized water source fluidly connected to and supplying said pressure vessel at the first end.

5. The system in accordance with claim 4, said system further comprising a drain fluidly connected to said pressure vessel.

6. The system in accordance with claim 5, said system further including a first temperature sensor operationally connected to said first stage heater and capable of sensing the operation of said first stage heater.

7. The system in accordance with claim 6, said system further including a second temperature sensor operationally connected to said second stage heater and capable of sensing the operation of said second stage heater.

8. The system in accordance with claim 7, said system further including a pressure sensing system fluidly connected to said piping header for sensing adequate steam pressure for the missile ejection.

9. A method for missile ejection, said method comprising the steps of:

providing a pressure vessel with a first stage heater and a second stage heater and a firing valve fluidly connected to the pressure vessel and an ejection system header;

initiating an opening of the firing valve; and ejecting pressurized steam from the pressure vessel via the firing valve to launch the missile.

10. The method in accordance with claim 9, said method further comprising the step of heating water in the pressure vessel to produce steam at a pressure level for missile launching.

11. The method in accordance with claim 10, said method further comprising the step of supplying de-mineralized water to the pressure vessel for replenishment of water to the pressure vessel.

12. The method in accordance with claim 11, said method further comprising the step of draining the pressure vessel to remove mineral deposits from the pressure vessel.

* * * * *